United States Patent [19]

Leskiw et al.

[11] 4,202,541

[45] May 13, 1980

[54] SUCTION FEED TABLE

[75] Inventors: Alexander Leskiw, Whitestone; Seth Graubert, Rockville Centre, both of N.Y.

[73] Assignee: S & S Corrugated Paper Machinery Co., Inc., Brooklyn, N.Y.

[21] Appl. No.: 911,184

[22] Filed: May 31, 1978

[51] Int. Cl.[2] ..... B65H 3/64

[52] U.S. Cl. ..... 271/132

[58] Field of Search ..... 271/132, 99

[56] References Cited

U.S. PATENT DOCUMENTS

| | | | |
|---|---|---|---|
| 3,709,483 | 1/1973 | Henc | 271/132 X |
| 3,767,186 | 10/1973 | Shields | 271/132 |
| 3,973,768 | 8/1976 | Shannon | 271/132 X |
| 3,994,489 | 11/1976 | Henc | 271/132 |
| 4,059,263 | 11/1977 | Henc | 271/132 X |

*Primary Examiner*—Richard A. Schacher

*Attorney, Agent, or Firm*—Ostrolenk, Faber, Gerb & Soffen

[57] ABSTRACT

Sheet feeding equipment is provided with suction means to assist a mechanical feeder that engages the trailing edge of the bottom blank in a stack and drives this bottom blank forward through a feed slot formed between a front gauge at the front of the stack and the horizontal surface which supports the stack. The suction assist means is provided with a chamber means having communicating front, intermediate and rear portions. The intermediate portion is relatively deep and the front and rear portions are relatively shallow. A suction device is connected to the intermediate section so that air is sucked rearward through the front section through its open front end and air is sucked forward through the rear section through its open rear end to produce a Bernoulli effect which acts on the bottom sheet to draw it downward against the support surface. The front section is relatively short and is substantially shallower than the rear section so that the Bernoulli effect is specially strong at the front section. The latter extends below the front gauge to assure that the bottom sheet will readily pass through the feed slot.

6 Claims, 7 Drawing Figures

121
120
202
201
204
204
103
104
103
104

121
19
17
119
120
17
18

100
111e
201
114
202
203
204
200
115
115a
5
110h
110i
110g
110f
110d
110c
110b
110a
6
7

SUCTION FEED TABLE

This invention relates generally to suction assist means for sheet feeding equipment and more particularly relates to an improvement of the sheet feeding equipment disclosed in U.S. Pat. No. 3,767,186 issued Oct. 23, 1973 to A. F. Shields for a Sheet Feeder Having Suction Assist.

In the paperbox making art, cutting and creasing presses, automatic folding machines, and other apparatus are operated at high speeds. Because of this, they are provided with automatic high speed sheet feeding equipment. It has been found that before the sheets are fed, it is advantageous to arrange them in a stack which is bulk loaded at the top and from which individual blanks are removed from the bottom by automatic feeding equipment. In the device of the aforesaid U.S. Pat. No. 3,767,186 the sheet feeding equipment utilizes a reciprocating mechanical feeder to engage the bottom blank in a stack of blanks to drive the bottom blank forward through a feed slot formed beneath the front gauge to be received by apparatus which operates on the blank. This prior art feeding apparatus includes a generally horizontal feed or support table having a chamber with a very shallow rear section open at its rear end. This chamber extends forward from the rear end of the stack. A suction device draws air forward through the shallow chamber section to draw the bottom sheet downward against the support table.

However, it has been found that while the prior art equipment has been effective to draw the rear section of a warped sheet against the feed table, the control of sheets having large warped conditions at the front thereof was oftan troublesome. That is, if the suction force was made sufficiently large to hold the front of a badly warped sheet against the feed table, the hold-down suction assist forces at the center of the bottom sheet became excessive. In order to eliminate the foregoing condition, the instant invention provides a shallow chamber section which is open at its forward end and is disposed below the front gauge and rearward thereof. This shallow front portion of the chamber is relatively short and relatively shallow so that a relatively large volume of air flows beneath the bottom blank at high velocity creating sufficient downward force to assure that the forward edge of the bottom blank rests against the feed table in position to pass through the feed slot formed between the bottom of the front gauge and the support table.

Accordingly, a primary object of the instant invention is to provide a novel suction assist means for a mechanical sheet feeder.

Another object is to provide a sheet feeder of this type which utilizes the Bernoulli effect to create forces which draw the leading edge region of the bottom blank in a stack downward against the feed table in the region immediately to the rear end immediately adjacent the front gauge.

A further object is to provide a sheet feeding means of this type in which the flow of air along the bottom surface of a stack is utilized to create suction forces drawing the bottom blank in the stack downward against the feed table and in which distribution of the suction forces are controlled so that they do not create excessive drag and at the same time assure that the forward edge of the bottom blank will rest against the feed table so as to pass readily through the feed slot.

These objects as well as other objects of this invention shall become readily apparent after reading the following description of the accompanying drawings in which.

Figure 1:
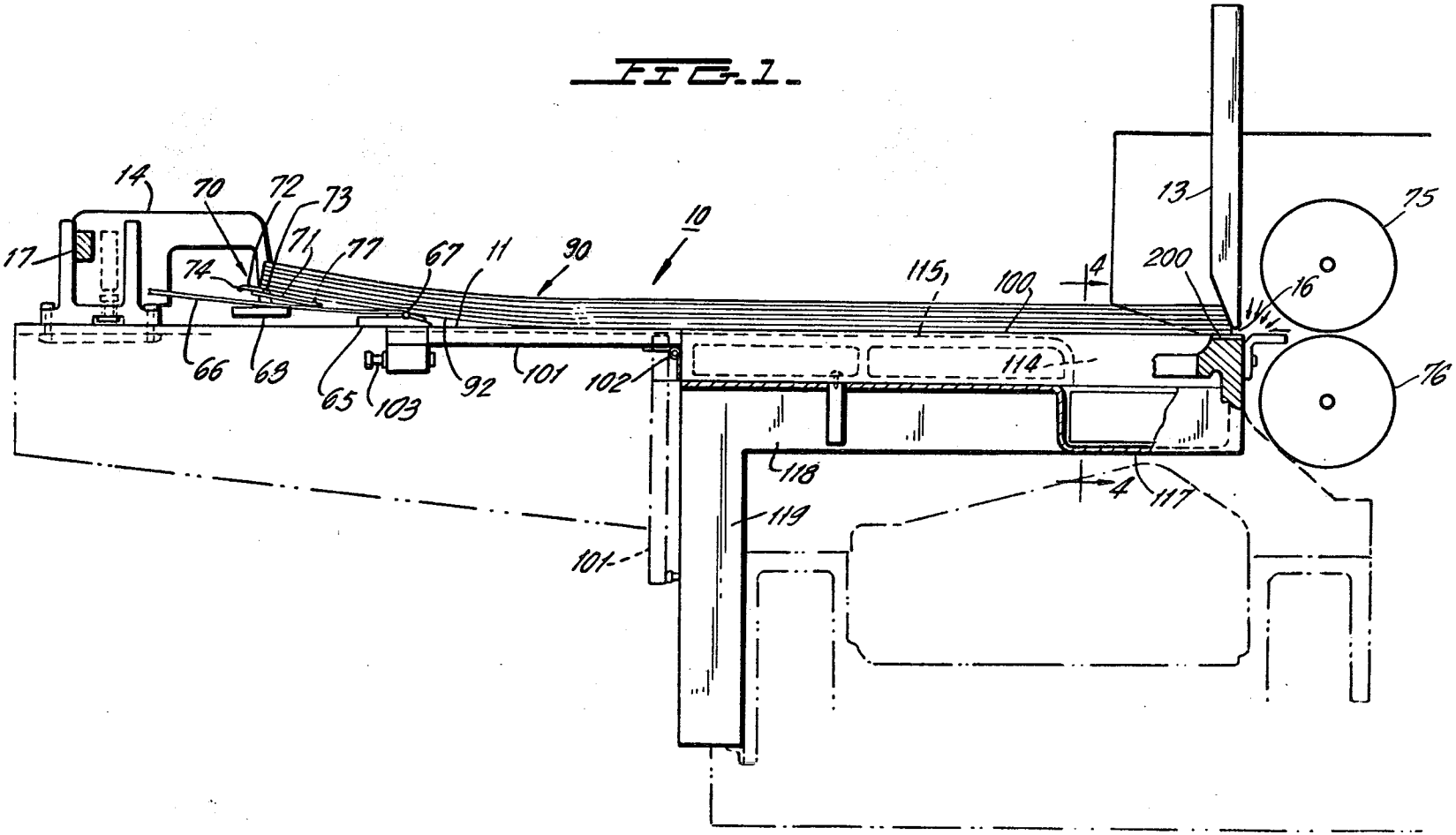
FIG. 1 is a side elevation of sheet feeding apparatus constructed in accordance with teachings of the instant invention.
Figure 2:
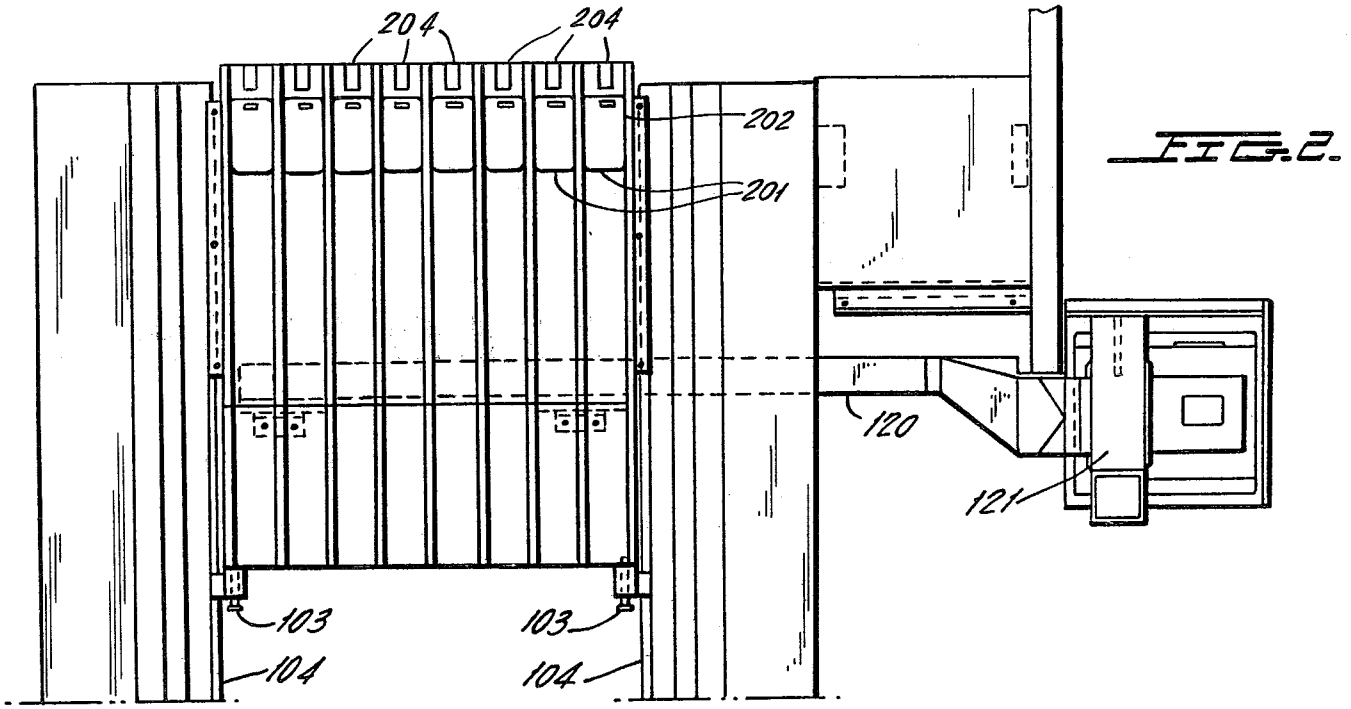
FIG. 2 is a plan view of the suction assist means in the apparatus of FIG. 1.
Figure 3:
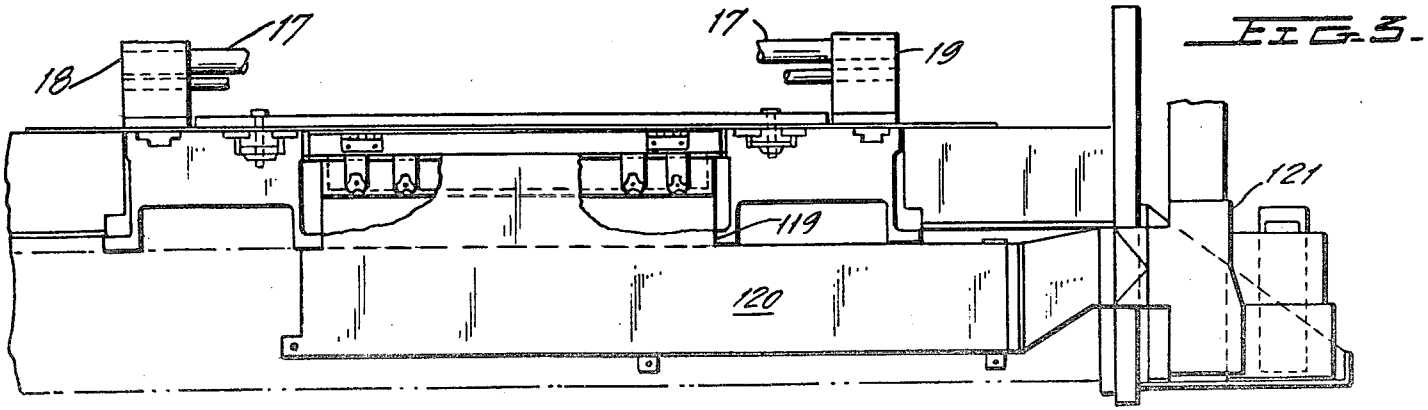
FIG. 3 is a rear elevation of the elements of FIG. 2.
Figures 4, 5, 6, 7:
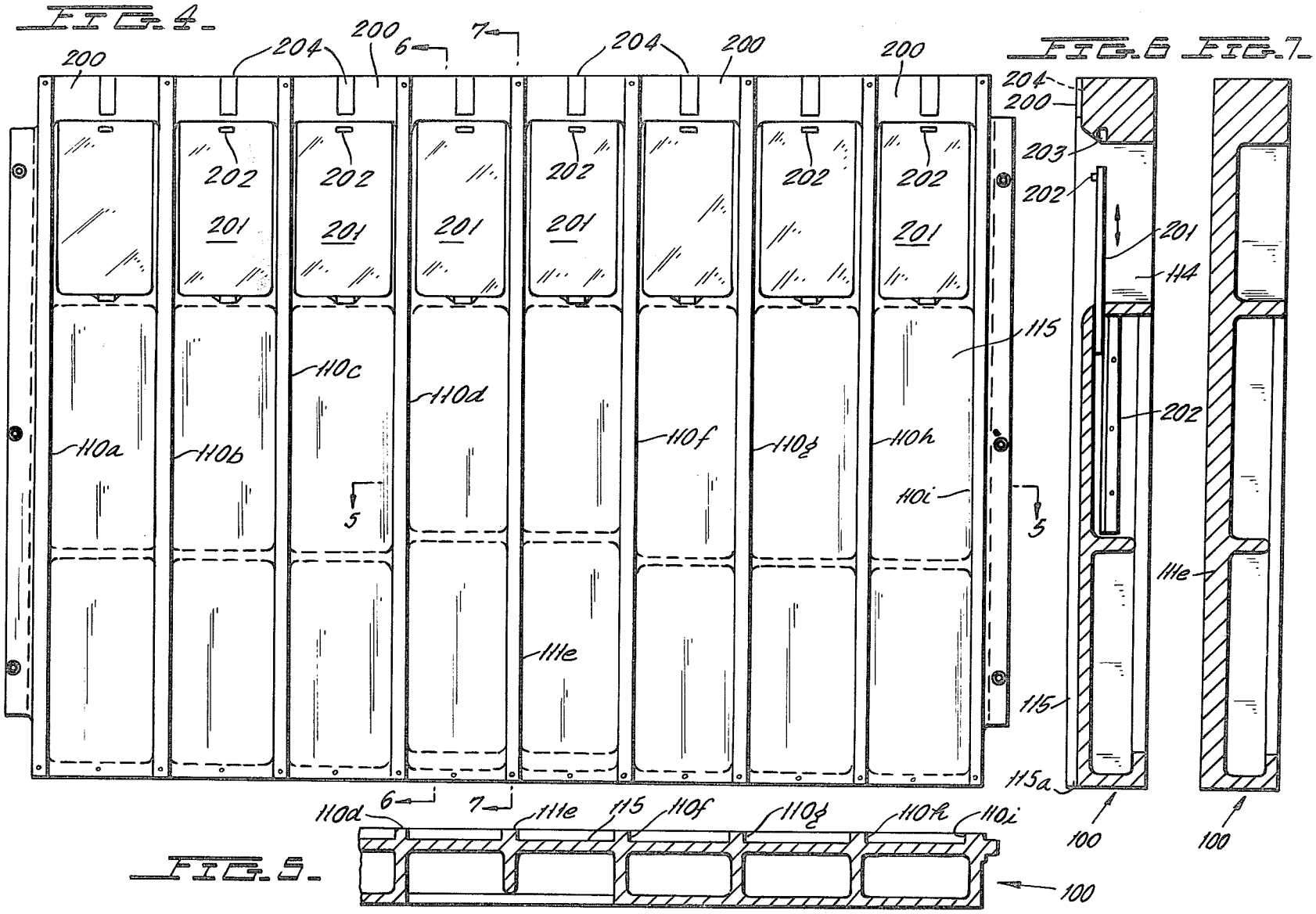
FIG. 4 is a plan view of the suction chamber casting.

FIGS. 5, 6 and 7 are cross-sections of FIG. 4, taken through the respective lines 5—5, 6—6 and 7—7, looking in the directions of the respective arrows 5—5, 6—6 and 7—7, Now referring to the FIGURES. In FIG. 1 it is seen that stack 90 of warped board rests upon support platform or bed 11 of automatic feeding mechanism 10, with the outwardly bowed side 92 stack 90 facing bed 11. Side gauges 12 position stack 90 laterally with respect to the feedpath while the front 13 and back 14 gauges maintain stack 90 in the appropriate longitudinal position prior to feeding. Front gauge 13 is vertically adjustable, in a manner well known to the art, and cooperates with bed 11 to define feed space or slot 16 which is high enough to permit the bottommost blank 91 to pass through while holding back the rest of stack 90.

The laterally spaced elements constituting rear gauge 14 are secured to cross member 17 which is positioned on the top side of bed 11 and extends between supports 18, 19 which are adjustable both longitudinally and vertically. For details of these adjustments, reference is made to the A. F. Shields U.S. Pat. No. 2,902,280 issued Sept. 1, 1959 for a Spring Feeder For Warped Board. Feed bar 65 carries a plurality of support plates 66 hingedly secured thereto at 67. Support plates 66 extend rearward from feed bar 65 and rest on plate support member 68 which extends laterally across the feed path and is secured to rear gauges 14 below cross member 17. Secured to each support plate 66 is a spring kicker 70 which comprises resilient member 71 extending upwardly at an incline from support plate 66, and a toothed member 72 having teeth 73 along its forward edge and a rounded portion 74 at its rear edge.

With supports 18, 19 raised to a position where elements 30, supporting the rear of stack 90, are raised sufficiently to align the leading edge of the lowest sheet 91 with feed space 16, moving the carriage mounting (not shown) for feed bar 65 to the rear will position spring kickers 70 to the left of the stack 90 and at a sufficient height so that spring 71 will be lightly loaded as teeth 73 engage the trailing edge of the bottom sheet 91 during the feedout stroke. Movement to the right with respect to FIG. 1 of feed bar 65 insures firm contact between spring kickers 70 and sheet 91, so that the latter may be driven forward through feed space 16 and thereafter engaged by feed rolls 75, 76 and be delivered to a machine for one or more operations.

Support plates 66, disposed between adjacent rear gauges 14, form the hypotenuse of a right triangle having one side of constant length equal to the vertical distance between the plate support member 68 and the top of feed bar 65. The other side is equal to the horizontal distance between the plate support member 68 and the top of feed bar 65. The other side is equal to the horizontal distance between hinge 67 and plate support member 68. As feed bar 65 moves forward in its feedout stroke, said other side increases in length bringing about a corresponding increase in the length of the hypotenuse. But the distance between hinge 67 and point 77 to which spring kickers 70 are affixed remains constant so that as a percentage of the hypotenuse, the distance between point 77 and hinge 67 decreases as feed bar 65 moves forward and point 77 is gradually lowered. This, in turn, lowers spring kickers 70, so that the loading of springs 71 does not change appreciably during the feed-out stroke since the distance between bed 11 and the bottom of stack 90 also decreases gradually between the back 14 and front 13 gauges. In this manner support plates 66, and, in turn, toothed members 72 follow the slight curvature of stack 90 while bottom sheet 92 is being fed to rollers 75, 76.

Support plates 66 supply a substantially rigid support at 77 for spring kickers 70 so that springs 71 never be severely loaded. Consequently, the contact pressure between toothed member 72 and the bottom of stack 90 is never sufficient to mar the bottom sheet 91 on the return stroke of feed bar 65. The round surface 74 of toothed member 72 reduces rubbing on the return stroke of feed bar 65.

Bed 11 is the upper surface of main casting 100 and collapsible rearward extension 101 thereof. Hinge 102 connects the forward end of extension 101 to the rear of main casting 100. Spring biased manually releasable latches 103 secured to frame elements 104 extend into notches at the rear of extension 101 to secure the latter in its operative position shown in solid lines in FIG. 1. The dashed line illustration for extension 101 shows the latter pivoted downward to its collapsed or inoperative position. Extension 101 is used in its operative position when the front to back distance of sheets being handled is no greater than the front to back distance of main casting 100.

Main casting 100 defines a chamber that is divided into a plurality of elongated compartments, extending parallel to the feed path, by walls 110*a*–110*i*, with the upper edges of these walls forming stack supporting bed 11. The compartment formed between adjacent walls, say 110*d* and 110*e*, has a relatively deep intermediate section 114, and even relatively shallower front section 200. Identical deep, shallow and shallower sectioned compartments are formed between walls 110*a* and 110*b*, 11*b* and 110*c*, 110*c* and 110*d*, 110*e* and 110*f*. 110*f* and 110*g*, 110*g* and 110*h*, 110*h* and 110*i*. The relatively deep compartment sections 114 are opened at the bottom and are connected directly to transverse manifold 117 connected by conduit sections 119, 120, to the intake of centrifugal blower 121. It is noted that rear shallow section 115 is open at the rear 115*a* thereof, just as the extensions of rear compartment sections 115 provided by extension 101 are open at their rear ends for a reason which will be hereinafter explained. Further, shallower front section 200 is open at its front end.

Casting 100 supports an individual sliding door or shutter 201 on angle irons 202 (only one of which is shown in FIG. 6) to close those portions of deep section 114 that are not required in that they extend beyond the sides of stack 90. Upward projection 202 on slide 201 is manually engageable for opening and closing slide 201. When the latter is in closed position its forward end extends into casting recess 203. Centered within each shallower section 200 is a narrow auxiliary support 204 disposed midway between adjacent walls 110*a*–*110i*, with the upper surfaces of auxiliary walls 204 being coplanar with the upper surface of walls 110*a*–*110i*.

During the operation of the device illustrated in FIG. 1, it is intended that those relatively deep intermediate compartment sections 114 through which there is air flow generated by suction blower 121 will be completely closed by stack 90. Thus, the distance from front gauge 113 to the rear of relatively deep section 114 is somewhat shorter than the front to back distance of the smallest blank that will be handled by feeder 10. However, there is a substantial, though small, opening between the bottom of stack 90 and each shallow compartment section 115 to provide an entry for air flow generated by suction blower 121 with such flow being forward at high velocity in the region below stack 90 and to the rear of relatively deep front section 114. Thus, even though blower 121 operates continuously, there is relatively little loss of air, and suction forces act over substantial portions of sheet 91 to the rear of relatively deep front section 114 to provide a suction assist force drawing sheet 91 downward. This force consists of the direct suction action at the relatively deep intermediate portion 114 of the chamber, and the action of high velocity air flowing from rear to front in the relatively shallow rear portion 115 of the chamber.

Shallower front compartment section 200 is open at its front end and extends below front gauge 13. In the short length of shallower compartment 200 between front gauge 13 and deep intermediate section 114 there is rearward air flow beneath the front of stack 90 with this flow being of relatively high velocity and being rearward. This assures that the forward edge of bottom blank 92 adjacent to front gauge 13 is drawn against support surface 111 and auxiliary support surfaces 204 to assure that sheets 92 will be driven through feed slot 16 rather than being hung-up on front gauge 13.

Although a preferred embodiment of this invention has been described, many variations and modifications will now be apparent to those skilled in the art, and it is therefore preferred that the instant invention be limited not by the specific disclosure herein, but only by the appending claims.

What is claimed is:

1. In equipment for successively feeding the bottom sheet from a stack of sheets along a generally horizontal feed path to additional apparatus positioned forward of said equipment; first means defining a generally horizontal support for said stack; guide means for maintaining the stack in position transverse to said path, rear gauge means at the rear of said stack, front gauge means positioned above said support to define a space between the lower end of said front gauge means and said support equal to slightly more than the thickness of one sheet and less than the thickness of two sheets, a carriage, means for recreciprocating said carriage parallel to said feed path, a mechanical feeder carried by said carriage, said mechanical feeder including feeder means operatively positioned at the rear of said stack when said carriage is in its most rearward position and operatively disposed to engage the trailing edge of said bottom sheet and drive the latter forward as said carriage moves forward from said most rearward position, second means for applying a suction assist force to draw the bottom of the stack downward; said suction assist force acting at said front gauge and for a substantial distance to the rear thereof; said second means for applying a suction assist force including a first portion acting from said front gauge rearward to a second portion of said second means; said first portion being derived from relatively high velocity air flow moving along the bottom of said stack rearward from the front gauge through a relatively shallow front portion of a chamber means; said chamber means constituting a portion of said second means disposed below said horizontal support and extending rearward from said front gauge; said second portion being derived from relatively high velocity air flow moving along the bottom of said stack forward from the rear of said stack through a relatively shallow rear portion of said chamber means; said front portion being relatively short and said rear portion being relatively long.

2. Equipment as set forth in claim 1 in which the front portion is substantially shallower than the rear portion.

3. Equipment as set forth in claim 1 in which the front portion is open at the front thereof and the rear portion is open at the rear thereof whereby the bottom sheet when resting on the horizontal support is ineffective to totally close off said chamber means at either end thereof.

4. Equipment as set forth in claim 3 in which the front portion is substantially shallower than the rear portion.

5. Equipment as set forth in claim 1 in which the chamber means also includes an intermediate portion communicating with said front and rear portions; third means for generating suction in said intermediate portion; said intermediate portion being relatively deep compared to said front and rear portions.

6. Equipment as set forth in claim 4 in which the chamber means also includes an intermediate portion communicating with said front and rear portions; third means for generating suction in said intermediate portion; said intermediate portion being relatively deep compared to said front and rear portions.

* * * * *